United States Patent [19]

Johnston

[11] 4,329,961

[45] May 18, 1982

[54] DIESEL INJECTION PUMP TIMING CONTROL WITH ELECTRONIC ADJUSTMENT

[75] Inventor: Laird E. Johnston, Birmingham, Mich.

[73] Assignee: General Motors Corporation, Detroit, Mich.

[21] Appl. No.: 192,108

[22] Filed: Sep. 29, 1980

[51] Int. Cl.[3] ..... F02M 59/20

[52] U.S. Cl. ..... 123/502

[58] Field of Search ..... 123/502, 501; 417/462

[56] References Cited

U.S. PATENT DOCUMENTS

| | | | |
|---|---|---|---|
| 3,797,469 | 3/1974 | Kobayashi et al. | 123/502 |
| 3,861,833 | 1/1975 | Salzgeber et al. | 417/254 |
| 4,052,971 | 10/1977 | Salzgeber et al. | 123/502 |
| 4,074,667 | 2/1978 | Skinner | 123/502 |
| 4,079,719 | 3/1978 | Varcoe et al. | 123/502 |
| 4,143,632 | 3/1979 | Kobayashi | 123/502 |

FOREIGN PATENT DOCUMENTS

| | | | |
|---|---|---|---|
| 171890 | 6/1960 | Sweden | 123/502 |
| 2031187 | 4/1980 | United Kingdom | 123/502 |

*Primary Examiner*—Ira S. Lazarus
*Assistant Examiner*—Magdalen Moy
*Attorney, Agent, or Firm*—Arthur N. Krein

[57] ABSTRACT

An engine driven fuel injection pump has a cam and pump plungers movable relative to the cam to translate the contour of the cam into a sequence of pumping strokes. A timing control mechanism, used to vary the rotative position of the cam as a function of engine operation, includes a control piston mounted in a cylinder and connected to the cam to control the position thereof whereby to advance and retard the relative timing of the pumping strokes. Movement of the control piston is controlled by hydraulic fluid supplied from a source of fluid under a pressure correlated with the operating speed of the associated engine. The control piston is slidable between a power piston biased by a resilient means in one direction and actuated in the opposite direction by hydraulic fluid from the source of fluid under pressure. A landed valve has its stem fixed to the spring biased means and its body portion is axially slidable in the control piston to control the flow of hydraulic fluid to either one end of the control piston for actuation thereof or to the opposite end of said control piston which is in fluid communication with fuel in the pump housing maintained at a predetermined reduced pressure. The axial position of this landed valve relative to the resilient means being controlled by means of an electric actuator as a function of engine operation whereby to trim movement of the control piston.

3 Claims, 1 Drawing Figure

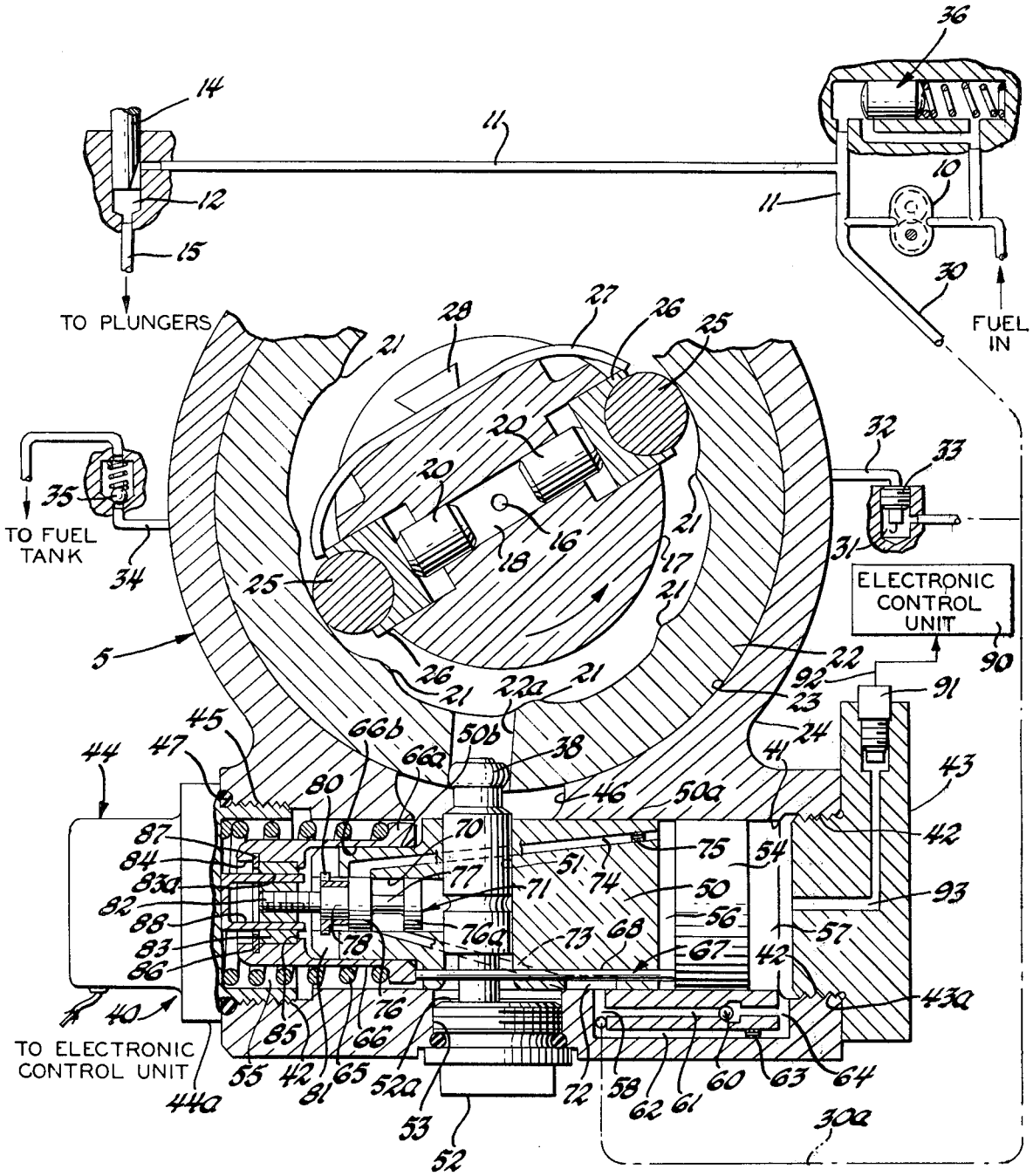
TO PLUNGERS
FUEL IN
TO FUEL TANK
ELECTRONIC CONTROL UNIT
TO ELECTRONIC CONTROL UNIT

DIESEL INJECTION PUMP TIMING CONTROL WITH ELECTRONIC ADJUSTMENT

FIELD OF THE INVENTION

This invention relates to diesel fuel injection pumps and, in particular, to a limited authority timing control means for such a pump that is operative to automatically vary the timing of the pump in response to engine operating conditions.

DESCRIPTION OF THE PRIOR ART

A conventional fuel injection pump, of the type disclosed, for example, in U.S. Pat. No. 3,861,833 entitled "Fuel Injection Pump" issued Jan. 21, 1975 to Daniel Salzgeber, Robert Raufeisen and Charles W. Davis, is adapted to deliver metered charges of fuel under high pressure sequentially to the cylinders of an associated engine in timed relationship therewith. In a pump of the above-identified type, a cam ring having inwardly directed cam lobes surrounds one or more pump plungers that are movable relative thereto whereby to translate the contour of the cam lobes into a sequence of pumping strokes producing the high pressure charges of fuel to be delivered to the engine.

Normally, a timing advance mechanism is used to adjust the angular position of the cam ring whereby to regulate the timing of injection into the cylinders of the engine as a function of engine speed. Such a timing advance mechanism may be hydraulically actuated as shown, for example, in U.S. Pat. No. 3,771,506 entitled "Fuel Injection Pump and Automatic Timing Means Therefor" issued Nov. 13, 1973 to Charles W. Davis or, it may be electro-hydraulically actuated as shown, for example, in U.S. Pat. No. 4,033,310 entitled "Fuel Pumping Apparatus with Timing Correction Means" issued July 5, 1977 to Wilfrid E. W. Nicolls.

SUMMARY OF THE INVENTION

The present invention relates to a limited authority injection pump timing control mechanism which uses an electronic controlled stepper motor to trim a hydraulic-mechanical timing advance mechanism.

It is therefore a primary object of this invention to provide an improved timing advance mechanism for an engine driven diesel fuel injection pump whereby an electronic controlled stepper motor is used to provide fine adjustment of a fuel injection pump timing function generated by a fluid pressure proportional to engine speed acting on a spring biased control piston.

Another object of this invention is to provide an improved timing advance mechanism for an engine driven fuel injection pump wherein the mechanism includes means to limit the amount of electronic timing control to only that which is needed for optimum performance, the hydraulic-mechanical portion of the mechanism controlling the basic timing function.

Still another object of the present invention is to provide a timing advance mechanism of the above type which includes features of construction, operation and arrangement, rendering it easy and inexpensive to manufacture, which is reliable in operation, and in other respects is suitable for use on production motor vehicle fuel injection pump systems.

For a better understanding of the invention as well as other objects and further features thereof, reference is had to the following detailed description of the invention to be read in connection with the accompanying drawing.

BRIEF DESCRIPTION OF THE DRAWING

The FIGURE is an end elevation view, partially in section and partly schematic, of a fuel injection pump having incorporated therein a timing control mechanism in accordance with the invention.

DESCRIPTION OF THE PREFERRED EMBODIMENT

As shown in the FIGURE, the subject timing control mechanism is incorporated into an engine driven fuel injection pump 5 of a type similar to that shown in the above-identified U.S. Pat. No. 3,861,833 that is operative to pressurize fuel sequentially to a plurality of injectors associated with the cylinders of an engine, both not shown. In this type pump, fuel at a predetermined pressure, as a function of engine speed, is delivered from the outlet of an engine driven transfer pump 10 via a passage 11 to a metering valve chamber 12. A metering valve 14, operatively positioned in the metering valve chamber 12, provides a variable restriction whereby to control the flow of fuel delivered by a passage 15 which is suitably connected, in a known manner, to an axial passage 16 in the distributor rotor 17 driven in a counterclockwise direction with reference to the FIGURE, whereby to supply fuel to the pump chamber 18 of the high pressure injection pump portion of the pump unit.

As shown, the high pressure injection pump includes a pair of opposed reciprocating plungers 20, the movements of which are controlled by circumferentially spaced apart, inwardly directed, cam lobes 21 of a cam ring 22. Cam ring 22 is mounted for limited angular movement in the circular bore 23 of the pump housing 24.

As is well known, in this type pump, the rotor passage 16 sequentially registers with the passage 15 as the distributor rotor 17 rotates when the pump plungers 20 are free to move radially outward whereby the pump chamber 18 can be supplied with a charge of fuel as determined by the control setting of the metering valve 14. Continued rotation of the distributor rotor 17 interrupts the communication between the rotor passage 16 and the passage 15 and, then, when the cam follower rollers 25 engage the rise of the cam lobes 21 they act through the rotor shoes 26 to force the pump plungers 20 inwardly so as to pressurize the fuel contained in the pump chamber 18 to a high injection pressure.

The thus pressurized fuel in the pump chamber 18 is then delivered by the rotor passage 16 to one of a series of passages, not shown, positioned in circumferentially spaced apart relationship to each other in the pump housing 24 around the distributor rotor 17 for sequential registry with the rotor passage 16, in a known manner, so as to effect the delivery of a charge of fuel from the pump chamber 18 sequentially to the cylinders of the associated engine. As is well known, the maximum outward radial movement of the shoes 26 may be limited, as desired, by engagement thereof with the ends of a leaf spring 27 adjustably mounted by a screw 28 to the distributor rotor 17.

In a known manner, the outlet of the transfer pump 10 is also connected by a passage 30 to the inlet of a fuel chamber 31, the outlet of which is connected by a passage 32 so as to supply fluid to the interior of the pump housing 24 whereby to provide for the lubrication of the various components of the pump mechanism mounted therein. The flow of fuel from the fuel chamber 31 out through the passage 32 is controlled by means of a vent wire assembly 33 in a manner known in the pump art.

Fuel thus supplied to the interior of the pump housing 24 for the lubrication of the pump elements is then returned via a return line 34 to the fuel tank. As shown, the fuel return line 34 has a pressure regulator 35 incorporated therein whereby the fuel within the pump housing can be maintained at a predetermined low pressure relative to the pressure of fuel as supplied by the transfer pump. This pressure within the pump housing is hereinafter referred to as the housing pressure. Also, as shown, a spring biased pressure regulating valve 36 is provided to control the output from the transfer pump 10 to a predetermined maximum value. The output pressure of the transfer pump hereinafter referred to as transfer pressure, will vary with the speed of the engine with which the fuel pump is associated. For example, in a particular embodiment, the housing pressure will vary from 0 to 5 psi (0 to 34.474 kPa) maximum, while the transfer pressure will vary from 0 to 90 psi (0 to 620.528 kPa) for engine speeds of 0 to 3000 rpm.

To vary the timing of injection of the fuel into the associated cylinders of the engine, the cam ring 22 is rotated to adjust the angular position of the cam lobes 21 by means of the timing control mechanism 40 of the invention, to be described hereinafter, which is connected by a cam pin 38, in a manner to be described, to the cam ring 22 and which is supplied with fuel at transfer pressure via a branch conduit **30*a*** in a manner and for a purpose to be described.

Referring now to the illustrated embodiment of the subject timing control mechanism 40, it is suitably supported in the pump housing 24 which is provided for this purpose with a through bore formed at right angles to the axis of bore 23 so as to provide a circular internal straight bore wall 41 with internally threaded bore walls 42 at opposite ends thereof.

One end, the right hand end of this through bore is suitably closed as by a closure plate 43 having the external threads **43*a* thereon engaged in the right hand threaded bore wall 42, with reference to the FIGURE. In the embodiment illustrated, the opposite end of this through bore is closed by a stepper motor 44 as by having the externally threaded portion of its motor casing 45 engaged in the left hand threaded bore wall 42 with a suitable annular seal 47 being used to effect a fluid tight seal between the flange 44*a* of the stepper motor and pump housing. As shown, the bore wall 41, intermediate its ends, communicates with one end of an elongated aperture 46 provided in the pump housing 24 whereby the opposite end of this aperture will open through the bore wall 23**, so as to provide for flow communication with the fuel, at housing pressure within the interior of the pump housing.

As shown, timing of the injection pump is controlled by moving the cam pin 38 whereby to move the cam ring 22 either in a clockwise direction, as seen in the FIGURE, to effect an advance in timing or, in a counter-clockwise direction to retard timing.

In accordance with the invention the cam pin 38 is adapted to move linearly with an advance or control piston, hereinafter referred to as the control piston 50 which is slidably received in the bore wall 41. For this purpose, the cam pin 38 is fixed to the control piston 50, as by having its intermediate cylindrical portion received in a cross bore 51 provided for this purpose in the control piston. As thus secured to the control piston, the upper end of the cam pin 38 projects up through the aperture 46 into a suitable aperture **22*a* extending radially through the cam ring 22 so as to effect movement thereof. As shown, the lower reduced diameter end of the cam pin 38 is positioned so as to have the bottom end surface thereof slidably abut against the bearing end surface 52*a* of a closure cap 52 threaded into the internally threaded intersecting bore 53 that is aligned with the aperture 46 in the pump housing 24**.

In accordance with a feature of the invention, major motion of the control piston 50 and therefore of the cam ring 22, is determined by metered transfered pump pressure, that is, transfer pressure acting on a power piston 54, as opposed by a resilient means, generally designated 55, in a manner to be described hereinafter.

As illustrated, the power piston 54 is slidably received in bore wall 41 between the right hand end of the control piston 50 and the closure plate 43 so as to form with these elements a variable volume control pressure chamber 56 and a variable volume power piston chamber 57, respectively, on opposite sides of the power piston 54.

Fuel at transfer pressure from transfer pump 10 is supplied to the power piston chamber 57 via the passage **30*a* and a feed passage 58 provided in the pump housing 24. Feed passage 58 is, in turn, connected by a ball check valve 60 control passage 61 positioned in parallel with a passage 62 having a flow control orifice 63 therein and by a connecting passage 64 opening through the bore wall 41 next adjacent to the inner end of closure plate 43. The passages 61 and 62 are thus operative to permit the rapid ingress of fluid at transfer pressure into the power piston chamber 57 whereby to permit rapid timing advance, and yet offer resistance to the reverse flow of fluid from the power piston chamber 57 that would effect retard as the rollers 25 engage the cam ring 22 lobes 21, with the distributor rotor 17** rotating in a counter-clockwise direction, as shown.

The resilient means 55, in the embodiment illustrated, includes a coil spring 65, of predetermined force and a tubular spring retainer. One end of the coil spring 65 is positioned so as to abut against a fixed stop, such as an end surface of the motor casing 45, while the opposite end of this spring is positioned so as to be in abutment against the angular flange **66*a* adjacent to the inboard end of the spring retainer 66. As shown, spring retainer 66 is of a suitable maximum external diameter whereby it will be slidably received loosely in bore wall 41 for axial movement therein with sufficient radial clearance existing between its outer peripheral surface and the interior of bore wall 41** so as to form an annular passage for the relatively unrestricted flow of fuel therethrough to opposite ends of the spring retainer.

The spring 65 and spring retainer 66 are operatively connected to the power piston 54 by means of a spacer means, of predetermined axial length, to provide for a predetermined fixed spacing between the opposing surfaces of the spring retainer 66 and the power piston 54.

In the embodiment illustrated, this spacer means is in the form of a pair of stop rods 67, only one of which is shown. Each such stop rod 67 slidably extends through a suitably longitudinal bore 68 provided in the control piston 50 whereby, in effect, the stop rod 67 is loosely supported thereby in a manner whereby the control valve 50 and stop rod 67 are free to move axially in either direction relative to each other for a purpose which will be described.

As illustrated, the force of spring 65 acting on spring retainer 66 will cause it to abut against one end of each stop rod 67 thus forcing the opposite end of that stop rod into abutment against the power piston 54 on the side thereof facing the control pressure chamber 56.

Referring again to the control piston 50 this piston is of stepped external diameters whereby to define a piston portion 50*a* of a diameter slidably received by bore wall 41 and a reduced diameter portion 50*b* slidably received in the enlarged internal bore wall 66*b* at one end of the spring retainer 66. The piston portion 50*a* is of a predetermined axial length less than the axial length of the stop rods 67 whereby the control piston 50 is free to move axially between the power piston 54 and the spring retainer 66 as these last two elements are axially spaced apart by the stop rods 67. Control piston 50 is also provided with an axial bore extending from the free end of the portion 50*b* of this piston so as to intersect the radial bore 51 whereby to provide a valve chamber 70 in which the landed portion of a servo piston 71 is slidably received.

In operation, valve chamber 70 is supplied with fuel at transfer pressure by means of an axial elongated groove 72 provided on the outer peripheral surface of control piston 50 so as to communicate with one end of the feed passage 58. This groove 72, in turn, is connected via an inclined passage 73 to the valve chamber 70, with the end thereof opposite groove 72 opening into the bore wall defining the valve chamber 70 toward its inboard end.

Valve chamber 70 and the control pressure chamber 56 are innerconnected by means of a passage 74, having a flow control orifice 75 of predetermined flow area therein, that is located in the control valve 50 so that the end of this passage 74 opening into the valve chamber 70 is axially positioned a predetermined distance outboard of the previously described passage 73 for a purpose to be described hereinafter.

As illustrated, the servo piston 71 is in the form of a landed valve having axial spaced apart left and right hand land portions 76 and 76*a* respectively, with reference to the FIGURE, that are sealingly and slidably received in the internal circular bore wall in the control piston 50 defining the valve chamber 70, and having a reduced diameter portion 77 between these land portions and a stem 78 extending axially outward from the lefthand land portion 76. Stem 78 at its inboard end has a tang sleeve 80 press fitted thereon whereby the tangs on this tang sleeve will be slidably received in slots 81 provided in the lefthand end of the reduced diameter portion 50*b* of control piston 50 so as to prevent rotation of the servo piston within the control piston. Stem 78 further includes a reduced diameter externally threaded free end stem portion 82 that is adapted to threadingly receive a captive nut 83 thereon.

Captive nut 83 is also suitably fixed to spring retainer 66 for movement therewith while being free to rotate relative thereto. For this purpose, the captive nut 83 has a circular outer peripheral surface that is rotatably received in a reduced diameter axial bore 84 at the opposite end of spring cage 66 from bore wall 66*a* and this nut is retained against axial movement relative to the spring retainer 66 as by being sandwiched between a shoulder 85 of the spring retainer 66 and a retainer ring 86 that is positioned in a suitable angular groove 87 provided for this purpose in the spring cage 66.

To effect its driven rotation, as desired, the captive nut 83 is provided with two spaced apart axial extending apertures 83*a* to slidably receive the two prong drive fork 88 at the free end of the shaft, not shown, of the stepper motor 44. With this arrangement, the captive nut 83 can be rotated upon actuation of the stepper motor 44 whereby to extend or retract the servo piston 71 relative to the captive nut 83 depending upon the direction of rotation of the stepper motor.

Thus if the captive nut 83 is rotated in a direction whereby the servo piston 71 is moved toward the captive nut 83, that is, to the left with reference to the FIGURE, the servo piston 71 will be moved to a position whereby the land portion 76 thereof is moved to the left from the position shown so as to allow fluid at transfer pressure flowing into the valve chamber 70 via passage 73 to flow out through the passage 74 and flow control orifice 75 into the control pressure chamber 56. Then as pressure increases in the control pressure chamber 56, the control piston 50 will be moved in an axial direction, toward the left with reference to the FIGURE, toward the captive nut 83. As this occurs the lower, valve chamber end of the passage 74 will be moved toward the left of the land portion 76 of the servo piston 71 so that the pressure in the control pressure chamber 56 flowing throughout the passage 74 can be relieved to housing pressure.

A stable position of the control piston 50 relative to the servo piston will then result and these components are then relatively oriented as shown in the FIGURE. Further travel of the servo piston 71 in either direction relative to the captive nut 83 will produce a corresponding motion of the control piston 50.

The stepper motor 44, used to effect rotation of the captive nut 83 to adjust the axial position of the servo piston 71, is connected electrically to an electronic control unit 90, such as an onboard computer. The electronic control unit 90 will be operative in a known manner to provide an electronical signal to the stepper motor 44 whereby to effect rotation of the captive nut 83 in either rotative direction, as desired. It will be apparent that the pitch of the mating threads on the stem 78 and in the captive nut 83 can be selected to obtain the desired axial displacement of the servo piston 71 for each revolution or part thereof of the captive nut 83.

In a known manner, the electronic control unit 90 would be supplied with various signals relating to engine operation, that is for example, signals relating to engine speed, engine timing as by a cam shaft position sensor, the quantity of fuel delivered and injection timing, all in a manner similar to that shown, for example, in the above-identified U.S. Pat. No. 4,033,310, whereby the electronic control unit would be operative, in a known manner, to provide the proper electrical input signal to the stepper motor 44 so as to effect advance or retard of timing as required depending on the engine operating condition.

In the embodiment illustrated, the injection timing signal is obtained by means of a start of injection pressure sensor 91, of a known type, which is positioned to monitor the metered transfer pressure of the fuel in the power piston chamber 57 whereby to provide a signal, by an electrical connection 92 to the electronic control unit 90. For this purpose, the closure plate 43 is provided with a passage 93 therein that opens at one end from the power piston chamber 57 and which at its opposite end is in flow communication with the injection pressure sensor 91 that is suitably secured to the closure plate 43 as by being threaded thereto.

It will now be apparent to those skilled in the art that the resilient means 55 will normally bias the power piston 54 and therefore the control piston 50 in a retard direction, to the right with reference to the FIGURE, effecting corresponding movement of the cam ring 22 in a counter-clockwise or retard direction. Movement of these elements in the retard direction will be limited, for example, by abutment of the power piston 54 against the inboard face of closure plate 43. Thus at start of engine and pump operation, the cam ring 22 will be rotated to a full retard position.

During engine operation, the transfer pressure is developed by the engine driven transfer pump 10, this pump thus being operative to generate a transfer pressure that is proportional to engine speed. Metered fuel at transfer pressure rapidly enters the power piston chamber 57 through the check valve 60 controlled passage 61 and also through the parallel passage 62 at a slower rate, as controlled by the size of the flow control orifice 63 therein.

Thus, at low engine speeds the transfer pressure will be such that the pump will operate at retarded timing. However, as engine speed increases, the transfer pressure will increase sufficiently to overcome the bias of spring 65 so that as fuel at this increased pressure is supplied to the power piston chamber 57 it will cause the power piston 54 to move in an axial direction, toward the left with reference to the FIGURE, toward the timing stepper motor 44, moving the spring retainer 66 via the stop rods 87 to compress the spring 65 against the bias force thereof. As this occurs, the servo piston 71 will move with the spring retainer 66 in an axial direction relative to the control piston 50 so that the passages 73 and 74 are then in flow communication with each other. As this occurs, fluid at transfer pressure will be supplied to the control pressure chamber 56 to effect further movement of the control piston 50 in an advance timing direction, to the left with reference to the FIGURE, causing clockwise movement of cam ring 22 until the stable position of the control piston 50 relative to servo piston 71 is achieved, as shown.

It should be realized that the pressure in the control pressure chamber 56 is always equal to or less than the pressure in the power piston chamber 57 but never less than the housing pressure which pressure acts against the opposite end of control piston 50 from control pressure chamber 56.

However in accordance with the invention, the start of injection pressure sensor 91 continuously monitors the pressure in the power piston chamber 57, which pressure will have a marked and sudden increase when the pumping reaction force causes the cam ring 22 to pivot in the timing delay direction, that is in a counter-clockwise directon with reference to the FIGURE. The electrical signal as a result of this pressure spike is compared in the electrical control unit 90 to a desired timing marked signal, which is developed for example, by a crankshaft position sensor, into reference information stored in the electrical control unit, in a manner well known in the electronic art.

If the thus measured timing as sensed by the start of injection pressure sensor 91 does not match the desired timing, an appropriate electrical signal is then supplied to the stepper motor 44 whereby to rotate the captive nut 83 so as to either retract or extend the servo piston 71, as required at that time relative to the captive nut 83. This change in the axial position of the servo piston 71 will cause a change in the control piston 50 axial location relative to that originally established by the resilient means 55 and power piston 54. Since the cam ring 22 is mechanically coupled to the control piston 50, its angular position effecting timing will be a direct function of control piston 50 location.

As engine speed decreases, injection timing will be retarded according to the balance between the pressure in the power piston chamber 56 acting against the bias of spring 65. If there is no stepper motor 44 rotation, the control piston 50 will move to the right, with reference to the FIGURE, in unison with the power piston 54. As described above the pressure in the control pressure chamber 56 is always equal to or less than the pressure in the power piston chamber 57 and never less than the housing pressure. Thus it will be apparent that if the stepper motor 44 should become inoperative, the axial location of the control piston 50 would then be determined solely by movement of the power piston 54, as controlled by the biasing force of the spring 65, in the manner described hereinabove.

As will be apparent, in addition to the differential pressure acting on the control piston 50, that is, the pressure in control pressure chamber 56 on one end of the control piston 50 as opposed by housing pressure acting against the opposite end, a force is applied thereto in a retard timing direction each time the cam follower rollers 25 ride up on the rise of cam lobes 21 during rotation of the distributor rotor 17 in the counter-clockwise direction shown, which force tends to cause the cam ring to move in a corresponding counter-clockwise direction.

With the arrangement of the timing control mechanism of the invention there is provided a means for limiting the amount of electronic timing control to only that which is needed for optimum performance while major control is done hydraulically. Thus the electronic control via the stepper motor is used to trim a hydraulic-mechanical control mechanism. With this arrangement no large axial load is imposed on the stepper motor to cause damage thereto.

The embodiments of the invention in which an exclusive property or privilege is claimed are defined as follows:

1. A timing control mechanism for an engine driven fuel injection pump of the type having an annular cam movably positioned in a pump housing, pump plungers movable relative to the cam to translate the contour of the cam into sequential pump strokes, and a source of fluid under a pressure correlated with an operating condition of the associated engine; said timing control mechanism including a cylinder in the pump housing; a power piston slidable in one end of said cylinder; a resilient means positioned in the opposite end of said cylinder and operatively connected to said power piston whereby to normally bias said power piston toward said one end of said cylinder; passage means including a flow control orifice connecting the source of fluid under pressure to said one end of said cylinder whereby to supply fluid to one side of said power piston so as to effect movement thereof toward the opposite end of said cylinder against the bias of said resilient means; a control piston slidable in said cylinder between said resilient means and said power piston and operatively connected to said cam to adjust the angular position thereof whereby to advance and retard the relative timing of the pumping strokes; a valve controlled passage means in said control piston, including a landed valve axially slidable in said control piston and having its stem fixed to said resilient means for movement therewith, said landed valve controlling flow of fluid from said valve controlled passage means to either one side or to the opposite side of said control piston whereby to control its axial position relative to said power piston; and, an electric actuator means operatively connected to said landed valve said electric actuator means being adapted to be connected to a controlled source of electrical power whereby to control the axial position of said landed valve relative to said resilient means as a function of engine operation.

2. A timing control mechanism for an engine driven fuel injection pump of the type having an annular cam movably positioned in a pump housing, pump plungers movable relative to the cam to translate the contour of the cam into sequential pump strokes, and a source of fluid under a pressure correlated with an operating condition of the associated engine, said timing control mechanism including a cylinder in the pump housing; a power piston slidable in one end of said cylinder; a resilient means positioned in the opposite end of said cylinder and operatively connected to said power piston whereby to normally bias said power piston toward said one end of said cylinder; passage means including a flow control orifice connecting the source of fluid to said one end of said cylinder whereby to supply fluid under pressure to one side of said power piston so as to effect movement thereof toward the opposite end of said cylinder against the bias of said resilient means; a control piston slidable in said cylinder between said resilient means and said power piston, said control piston being operatively connected to said cam to adjust the angular position thereof whereby to advance and retard the relative timing of the pumping strokes; a valve controlled passage means in said control piston, said valve controlled passage means including a valve having a landed portion thereof axially slidable in said control piston and having a threaded stem extending outboard of said control piston; a nut threaded onto said threaded stem and fixed to said resilient means for movement therewith, said landed valve controlling flow of fluid from said valve controlled passage means to either one side or to the opposite side of said control piston whereby to control its axial position relative to said power piston; and, electric actuator means operatively connected to said nut to effect rotation thereof whereby to adjust the axial position of said valve relative thereto as a function of engine operation.

3. A timing control mechanism for an engine driven fuel injection pump of the type having an annular cam movably positioned in a pump housing containing fuel at a predetermined relatively low housing pressure, pump plungers movable relative to the cam to translate the contour of the cam into sequential pump strokes, and a source of fluid under a transfer pressure correlated with an operating condition of the associated engine, said timing control mechanism including a cylinder in the pump housing; a power piston slidable in one end of said cylinder; a resilient means positioned in the opposite end of said cylinder in flow communication with the fuel at predetermined relatively low housing pressure, said resilient means being operatively connected to said power piston whereby to normally bias said power piston toward said one end of said cylinder; passage means including a flow control orifice connecting the source of fluid under transfer to said one end of said cylinder whereby to supply fluid to one side of said power piston so as to effect movement thereof toward the opposite end of said cylinder against the bias of said resilient means; a control piston slidable in said cylinder between said resilient means and said power piston; one end of said control piston forming with said cylinder and said power piston a control pressure chamber and its opposite end being acted upon by fuel at housing pressure; said control piston being operatively connected to said cam so as to effect the angular position thereof whereby to advance and retard the relative timing of the pumping strokes; a valve controlled passage means in said control piston, including a landed valve axially slidable in said control piston and having its stem adjustably fixed to said resilient means for movement therewith, said landed valve controlling flow of fluid from said valve controlled passage means to either said control pressure chamber on one end of said control piston or to the oppostie end of said control piston in communication with fuel at housing pressure whereby to control its axial position relative to said power piston, and, electric actuator means operatively connected to said landed valve for controlling the axial position thereof relative to said resilient means as a function of engine operation.

* * * * *